United States Patent [19]

Hanson

[11] Patent Number: 4,711,476

[45] Date of Patent: Dec. 8, 1987

[54] KNOT

[75] Inventor: Alden W. Hanson, Midland, Mich.

[73] Assignee: Helen L. Hanson, Midland, Mich.

[21] Appl. No.: 933,153

[22] Filed: Nov. 21, 1986

[51] Int. Cl.[4] ..... D04G 5/00; B65H 69/04

[52] U.S. Cl. ..... 289/1.2; 289/1.5

[58] Field of Search ..... 289/1.2, 1.5

[56] References Cited

U.S. PATENT DOCUMENTS 2,591,854 4/1952 Nellis ..... 289/1.2
2,619,704 12/1952 Frontel ..... 289/1.2
2,804,676 9/1957 Smith ..... 289/1.2

FOREIGN PATENT DOCUMENTS 0870206 6/1961 United Kingdom ..... 289/1.2

*Primary Examiner*—Louis K. Rimrodt
*Attorney, Agent, or Firm*—Learman & McCulloch

[57] ABSTRACT

A knot or bend for use with single or multiple lengths of material and comprising an overhand knot entwined with a crossing knot. The resulting knot or bend is decorative and capable of being tied in a variety of different ways. The knot or bend has great security, but easily may be loosened and untied when desired.

19 Claims, 34 Drawing Figures

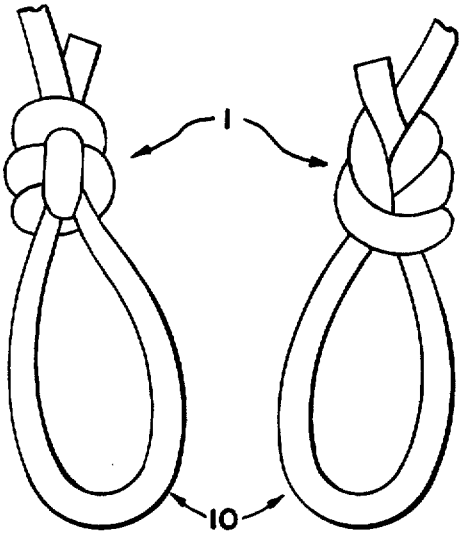
FIG.1
FIG.2
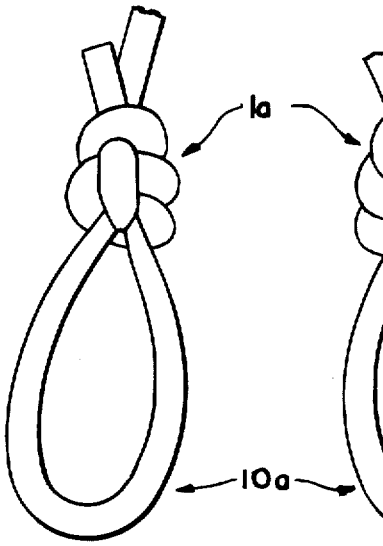
FIG.3
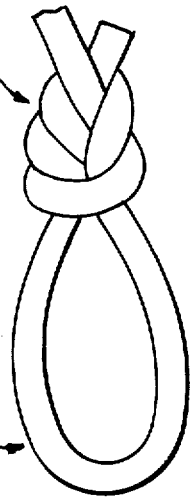
FIG.4
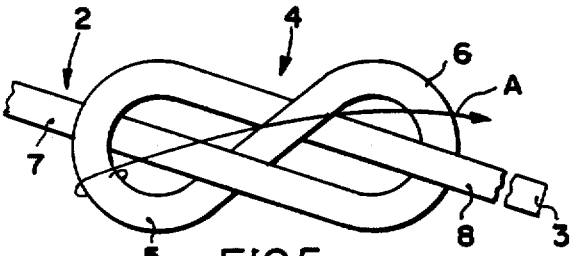
FIG.5
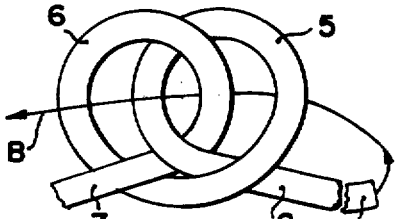
FIG.6
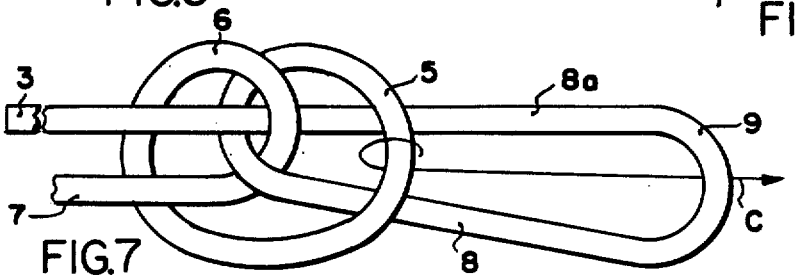
FIG.7
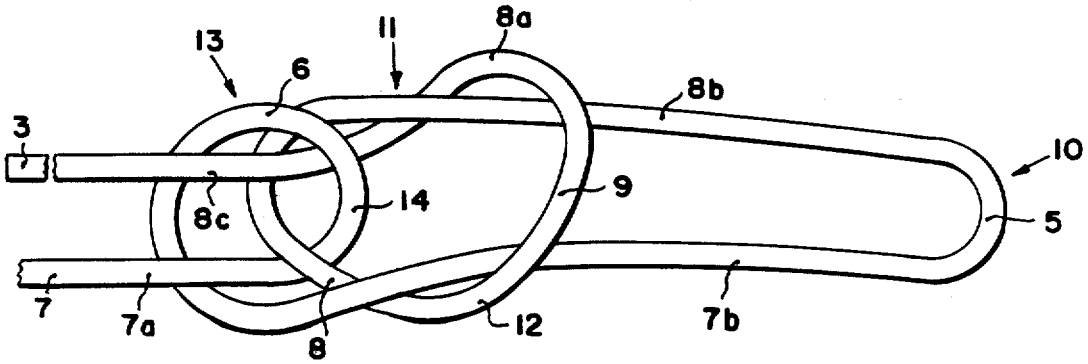
FIG.8

KNOT

This invention relates to the tying of knots and bends in ropes.

BACKGROUND OF THE INVENTION

The art of knot and bend tying is an ancient one and has developed over the centuries to a considerable degree of sophistication. Thousands of knots and bends are illustrated and described in numerous publications and generally are of two classifications: decorative and practical. Of course, knots and bends may be both practical and decorative, thereby increasing the potential for their use.

The character of a knot or bend is determined by its purpose. That is, some are intended to be nonslipping, whereas others are intended to slip. In any event, a well-designed knot or bend should be recognizable in form, capable of being learned and tied quickly, perform its function, and still be capable of being loosened and untied quickly and easily when desired. Not all knots and bends, however, possess the quality of being easily loosened and untied, even though they otherwise may be satisfactory.

Some knots and bends are of such nature that they may be tied in one way only, whereas others may be tied in two or more different ways. A knot or bend that can be tied in more than a single manner generally has wider applicability and may be learned more easily.

SUMMARY OF THE INVENTION

A knot or bend (hereinafter sometimes referred to simply as "knot" for convenience) according to the invention is adapted for use with single ropes or cordage or for bending multiple ropes together. The knot may be formed in a plurality of different ways. Regardless of the manner in which the knot is formed it has uniformly high security and is both distinctive and decorative in appearance. The knot also easily and quickly may be loosened and untied when desired.

The material from which the knot is formed may be any one of a number of different textiles, either natural or synthetic, or metallic, or both, as in the case of braiding. The knot may be utilitarian or ornamental, such as a frog or an article of jewelry.

A knot according to the invention is not symmetrical, but the differences in symmetry do not detract from its appearance. In fact, the differences in symmetry result in a knot tied in either a left- or right-hand manner presenting a mirror image of a knot tied in the opposite hand manner.

THE DRAWINGS

A knot according to the invention is disclosed in the following description and the accompanying drawings, wherein:

FIG. 1 is a front elevational view of a knot formed according to one embodiment of the invention;

FIG. 2 is a rear elevational view of the knot shown in FIG. 1;

FIG. 3 is a front elevational view of the knot tied in such way as to form a mirror image of the knot shown in FIG. 1;

FIG. 4 is a rear elevational view of the knot shown in FIG. 3;

FIGS. 5, 6, 7 and 8 are diagrammatic views illustrating sequential steps that may be performed in tying the knot of FIGS. 1 and 2;

Figure 11:
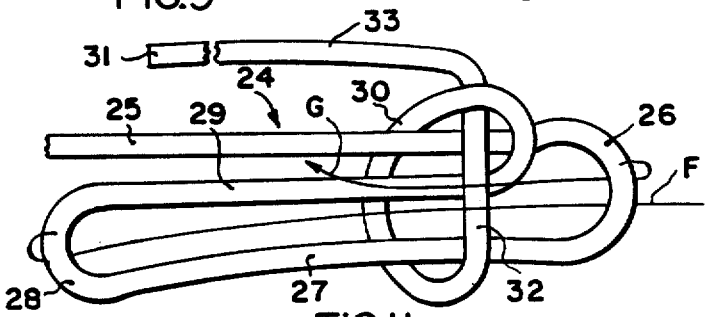
Figure 12:
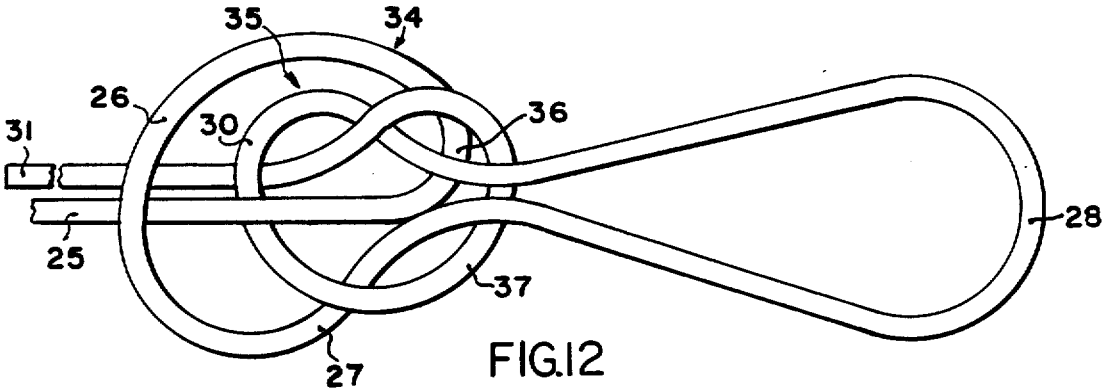
Figure 13:
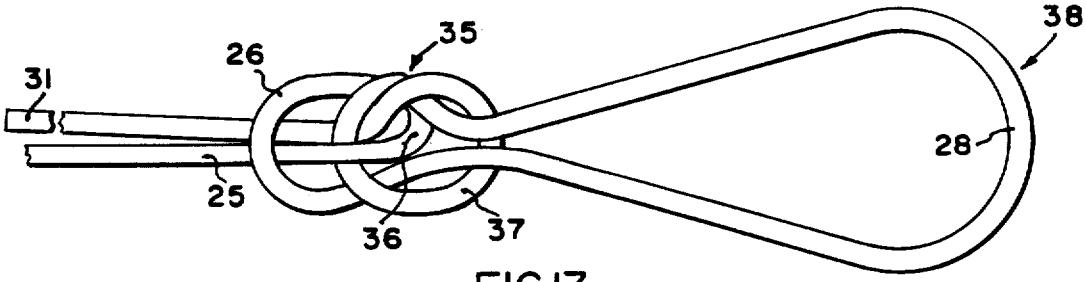
Figure 14:
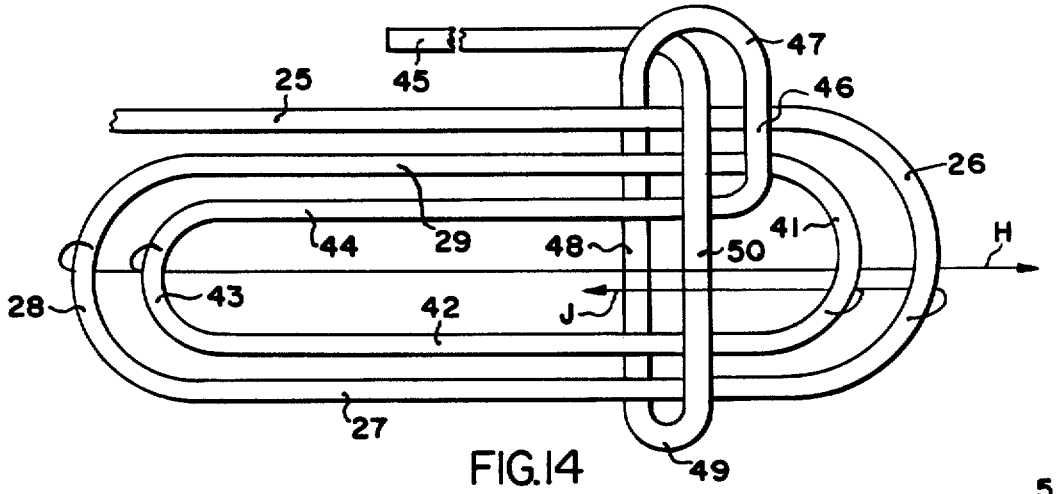
Figure 15:
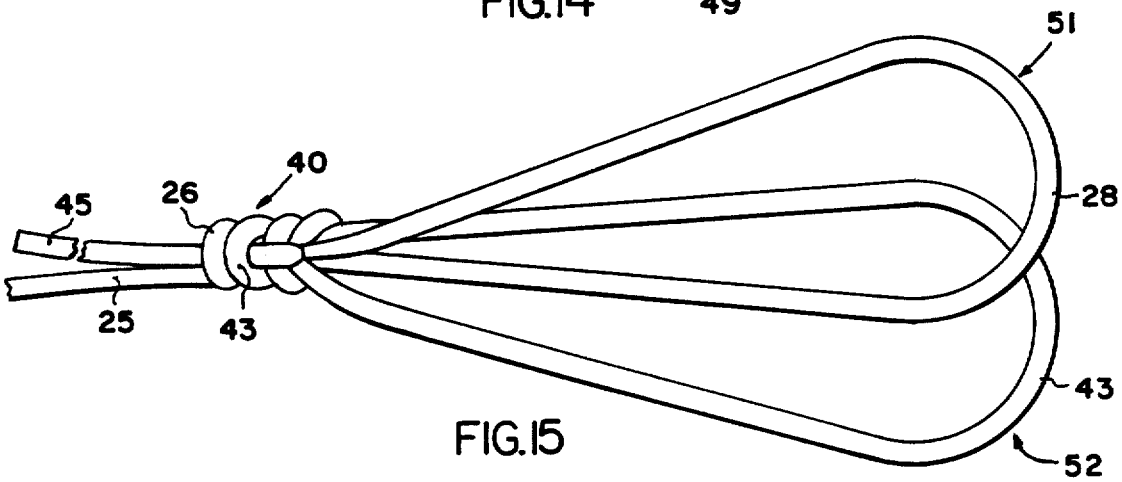
Figure 16:
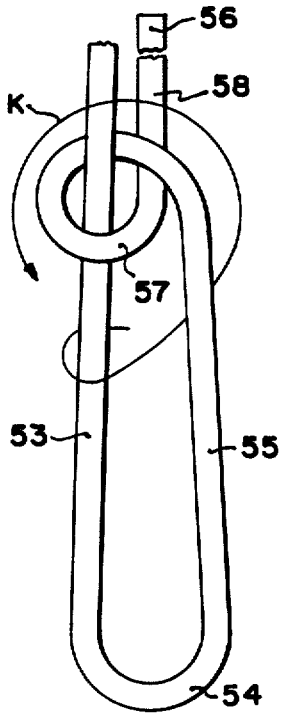
Figure 17:
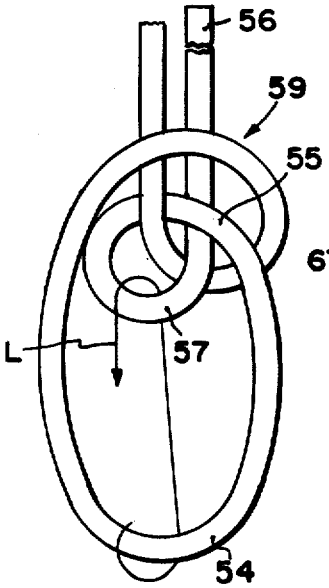
Figure 18:
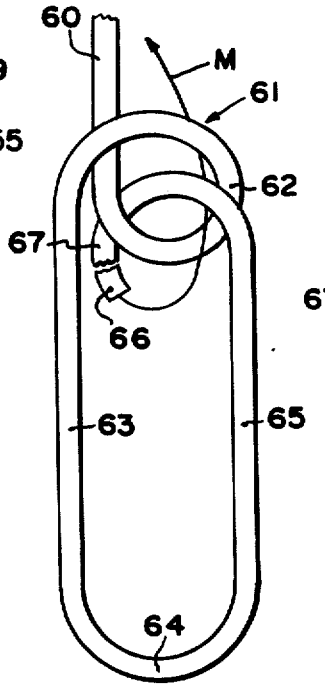
Figure 19:
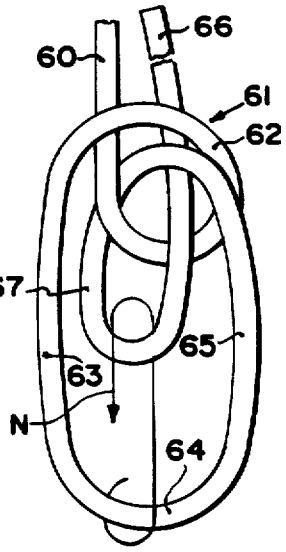
Figure 20:
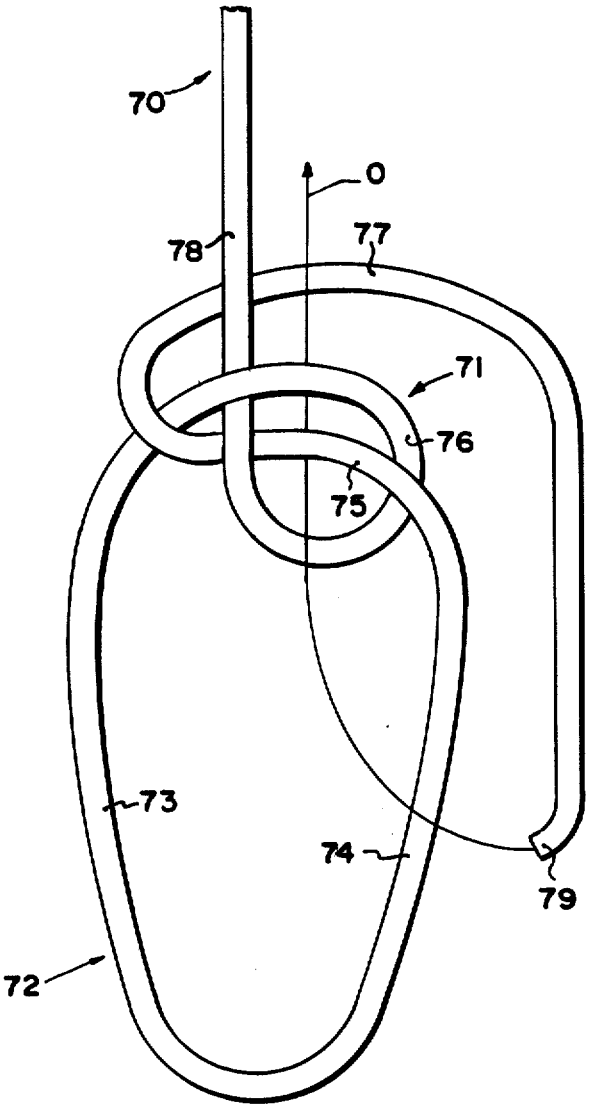
Figure 21:
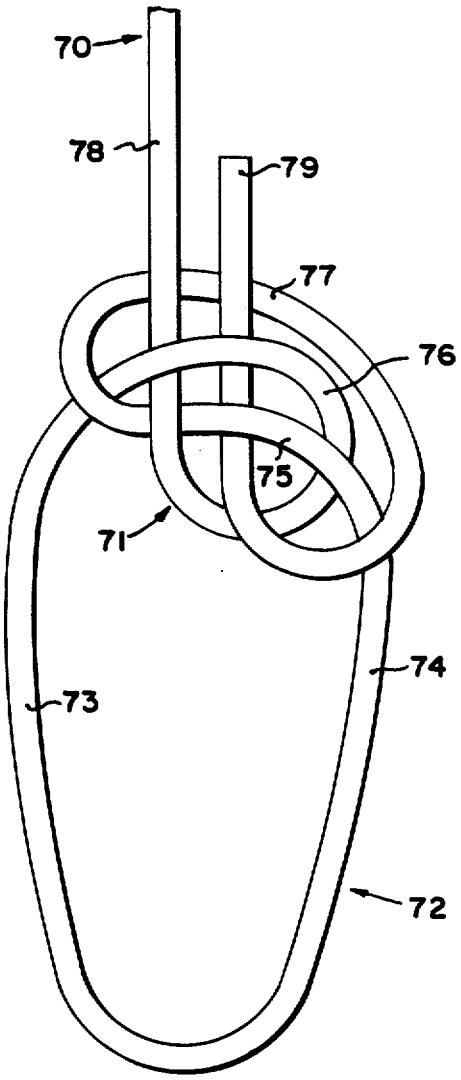
Figure 22:
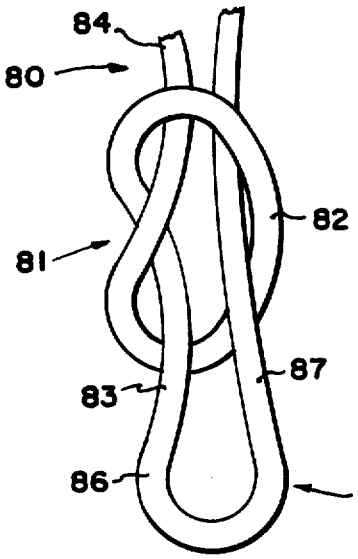
Figure 23:
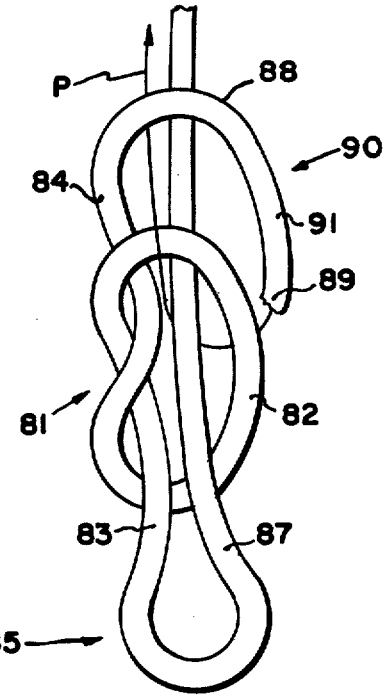
Figure 24:
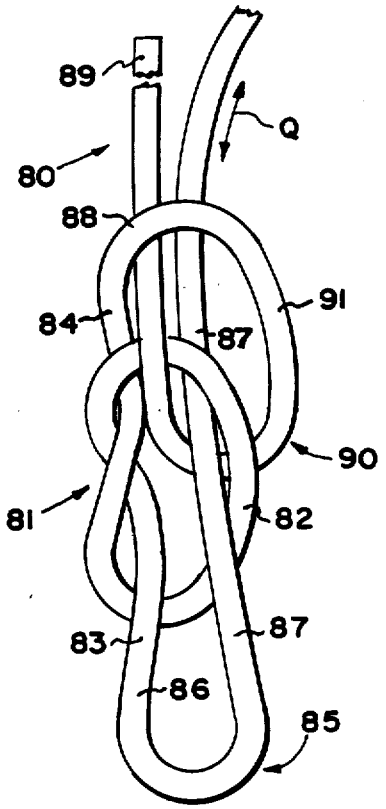
Figure 25:
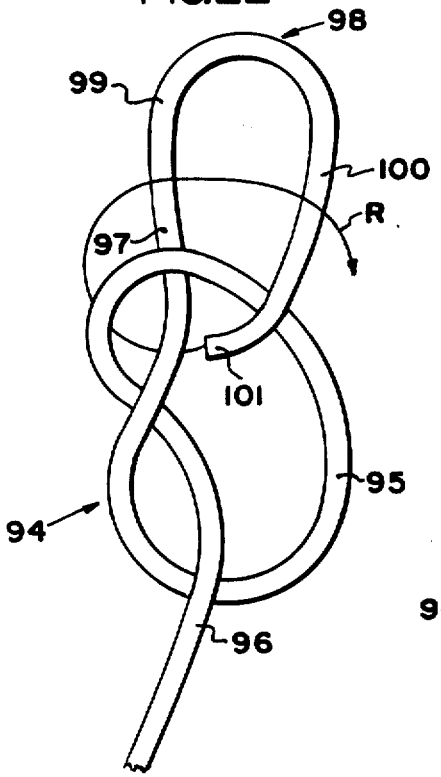
Figure 26:
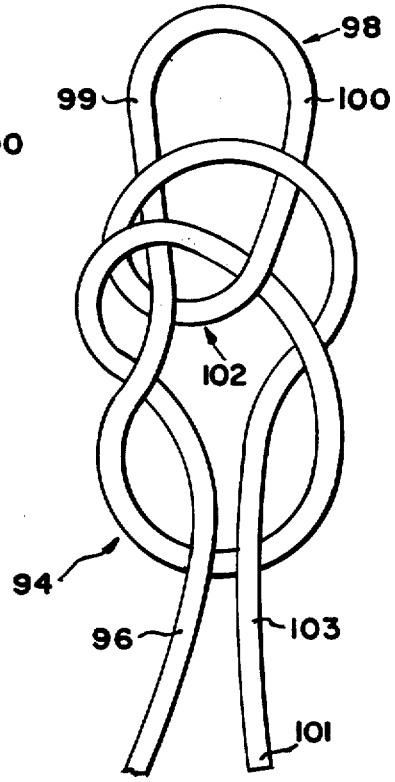
Figure 27:
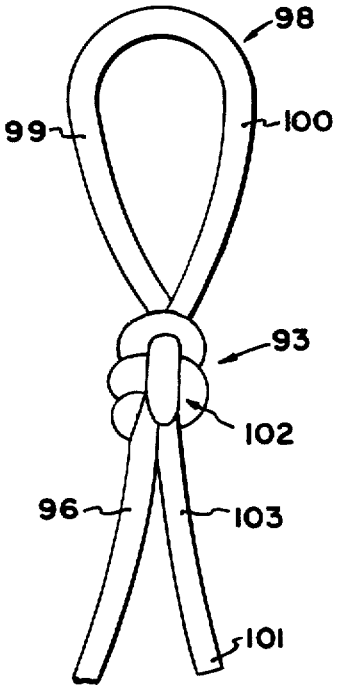
Figure 30:
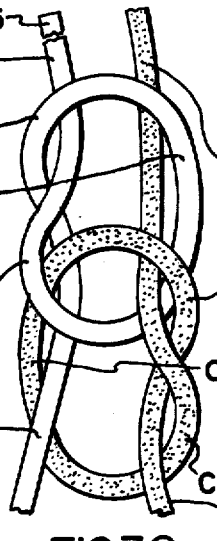
Figure 31:
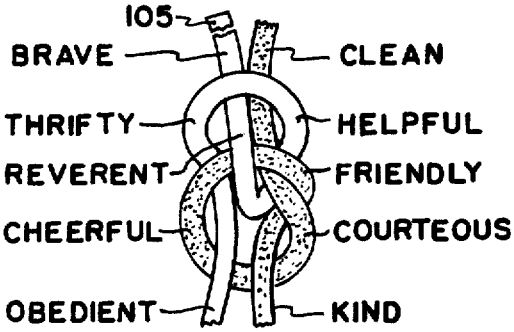
Figure 32:
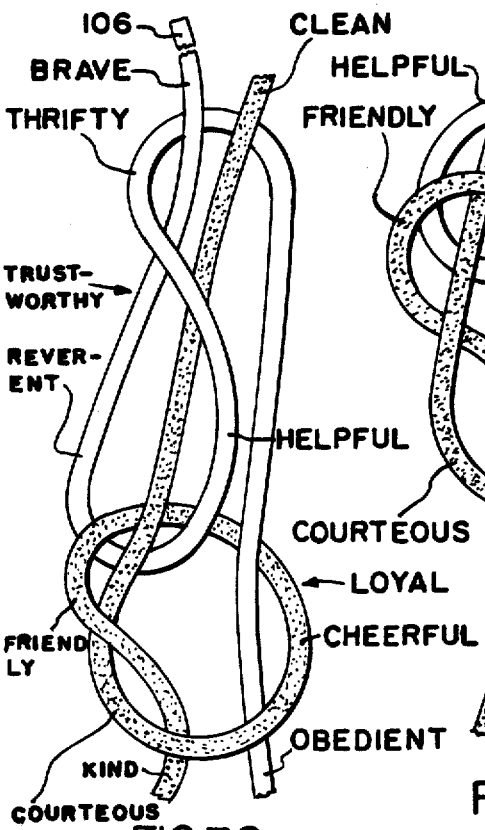
Figure 33:
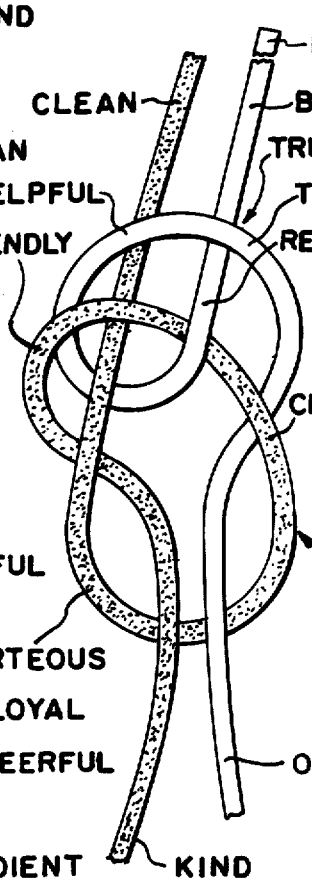
Figure 34:
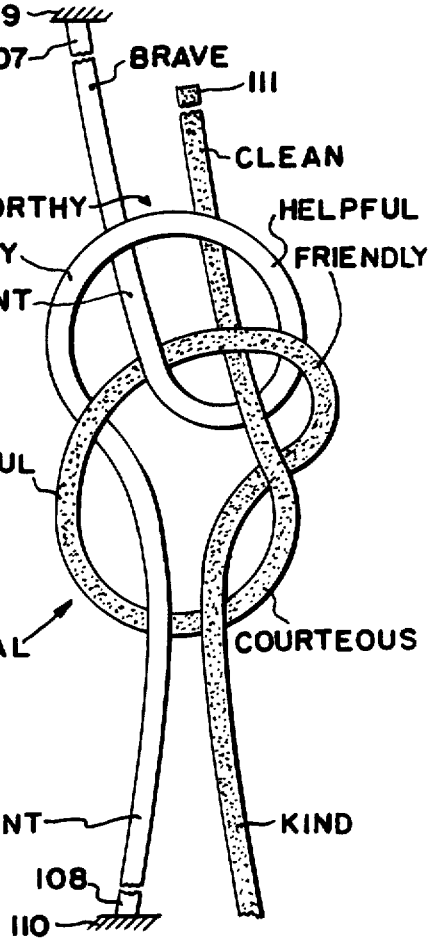

FIGS. 11, 12, and 13 are diagrammatic views illustrating one manner in which the knot shown in FIGS. 3 and 4 may be tied;

FIGS. 14 and 15 are diagrammatic views illustrating a variation of the knot shown in FIGS. 11-13;

FIGS. 16 and 17 are diagrammatic views illustrating another manner in which the knot of FIGS. 3 and 4 may be tied;

FIGS. 18 and 19 are diagrammatic views illustrating a modification of the procedures shown in FIGS. 16 and 17;

FIGS. 20 and 21 are diagrammatic views illustrating another manner of tying the knot;

FIGS. 22-24 are diagrammatic views illustrating how the knot may be tied to form a running noose;

FIGS. 25 and 26 are diagrammatic views illustrating the manner of forming a knot which is a modification of that shown in FIG. 1;

FIG. 27 is a front elevational view of the finished knot formed in the manner shown in FIGS. 25 and 26;

FIGS. 28-31 are diagrammatic views illustrating how the knot according to the invention may be used to bend two ropes to one another; and FIGS. 32-34 illustrate variations in the manner of bending two ropes to one another.

THE PREFERRED EMBODIMENTS

FIG. 1 illustrates the front side of a knot 1 and FIG. 2 illustrates the rear side of the same knot. FIG. 3 illustrates the front side of a knot 1*a* that is a mirror image of the knot 1. FIG. 4 illustrates the rear side of the knot 1*a*. The knots 1 and 1*a* are finished in the sense that they are shown as being tightly drawn, rather than loose.

FIGS. 5-8 illustrate one manner of tying the knot 1 from a single length 2 of rope or other flexible material having a working end 3. The length of rope has a figure eight knot 4 formed therein so as to produce two loops 5 and 6 from which two sections 7 and 8 of the rope extend in opposite directions. The loop 5 is moved or swung in the direction of the arrow A to the position shown in FIG. 6. The working end 3 then is turned and reeved through both of the loops 5 and 6, moving in the direction of the arrow B, and underlying the right-hand segment and overlying the left-hand segment of each loop. These manipulations result in the formation of a bight 9 having one leg formed by the rope section 8 and a second, substantially parallel leg formed by an extension 8*a* of the rope section 8. Following movement of the working end 3 through the loops 5 and 6 the right-hand segment of the loop 5 is drawn through the bight 9, as is indicated by the arrow C, to form a loop 10.

The steps just described produce an overhand knot 11 having a bight 12 and a crossing knot 13 having a bight 14 which passes through the bight 12 and entwines the overhand and crossing knots. Each of the overhand and crossing knots has two rope sections extending in opposite directions from the respective knots. Thus there is a total of four rope sections. The two sections extending in opposite directions from the overhand knot are designated 8*b* and 8*c* in FIG. 8 and the two sections extending in opposite directions from the crossing knot are designated 7*a* and 7*b*. Since the sections 7*b* and 8*b* are joined by a segment of the loop 5, they are common to both the overhand knot and the crossing knot and form the loop 10.

Upon pulling the working end 3 and the loop 10 in opposite directions, the knot will be tightened to produce the form of knot shown in FIGS. 1 and 2.

Figure 9:
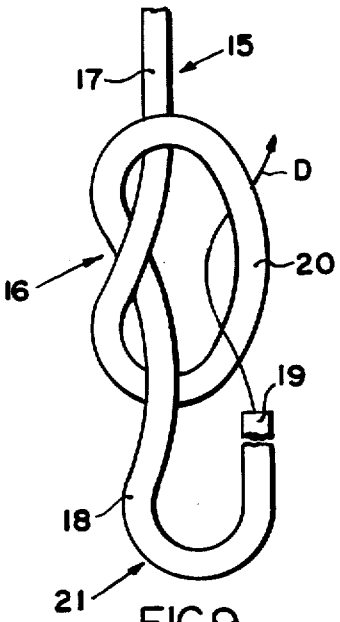
FIGS. 9 and 10 are diagrammatic views illustrating another manner in which the knot of FIGS. 1 and 2 may be tied.
Figure 10:
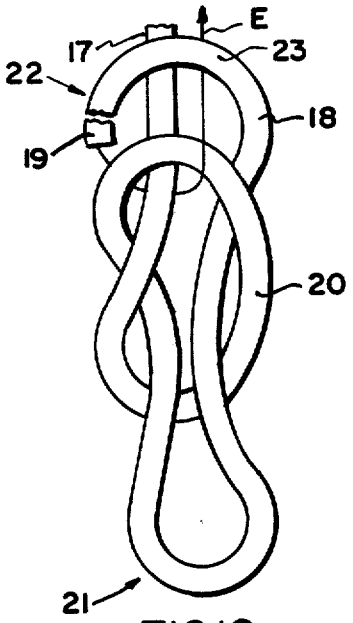

FIGS. 9 and 10 illustrate another method of tying the knot 1 shown in FIGS. 1 and 2. In this embodiment a length 15 of rope has an overhand knot 16 tied therein so that two sections 17 and 18 of the rope extend from the knot in opposite directions. The section 18 terminates in the working end 19 which is reeved downwardly through the bight 20 of the overhand knot, as is indicated by the arrow D, to form a loop 21. The working end 19 is turned to overlie and cross the section 17 and then is reeved upwardly through the bight 20 of the overhand knot 16 and thence moved in the direction of the arrow E, thereby forming a crossing knot 22 having a bight 23. The working end 19 parallels the section 17 and passes beneath the bight 23. The crossing knot thus has two rope sections extending in opposite directions, one of the sections comprising the section 18 and the other the working end 19. The knot 1 then may be formed by tightening the overhand knot first and then tightening the crossing knot.

One manner of tying a knot like that shown in FIGS. 3 and 4 is illustrated in FIGS. 11–13. A length 24 of rope has a section 25 reversely turned to form a bight 26 and a run 27 parallel to and spaced from the section 25. The run 27 is reversely turned to form a bight 28 from which extends a run 29 that parallels and occupies a position between the section 25 and the run 27. The run 29 is turned to overlie the section 25 and then is turned further to underlie the section 25 and both runs 27 and 29, thus forming a bight 30.

From the bight 30 the working end 31 is turned to form a run 32 that overlies both of the runs 27 and 29 and the section 25, and is reeved downwardly through the bight 30. The working end then is extended to form a run 33 parallel to the section 25.

The bight 28 is moved in the direction of the arrow F to overlie the run 32 and pass through the bight 26, following which the bight 26 is swung in the direction of the arrow G, thereby producing, as is shown in FIG. 12, a crossing knot 34 and an overhand knot 35. The crossing knot has a bight 36 extending through the bight 37 of the overhand knot. The bight 28 forms a loop 38. A corresponding loop is shown in FIGS. 3 and 4 at 10*a*. When tightened the knot formed by the procedure shown in FIGS. 11–13 corresponds to that shown in FIGS. 3 and 4. One advantage of tying the knot in this manner is that the size of the loop 38 may be determined quite accurately in advance of completing the knot.

The overhand knot 35 shown in FIG. 12 is a left-hand overhand knot whereas the knots 11 and 16 shown in FIGS. 8 and 9, respectively, are right-hand overhand knots. A comparison of the overhand knots shown in FIGS. 8 and 9 with the overhand knot shown in FIG. 12 will reveal the difference and it will be observed that the rope sections 25 and 31 extending from the left-hand end of the knot cross and underlie the bight 26 of the crossing knot, whereas the rope sections which extend from the right-hand end of the knot cross and overlie the bight 37 of the overhand knot. Some overhand knots disclosed in drawing figures described hereinafter are right-hand and others will be left-hand. For purposes of this description, however, no distinction is made between left- and right-hand overhand knots.

The knot 40 shown in FIG. 15 is formed in the manner illustrated in FIG. 14. The method of tying the knot 40 is similar to that used in tying the knot shown in FIG. 13 in that the knot 40 includes the section 25 and the two runs 27 and 29. In forming the knot 40, however, the run 29 is turned to form a further bight 41 and another run 42 that is turned to form a bight 43 and a further run 44, all of the runs 27, 29, 42, and 44 being parallel to one another. From the run 44 the working end 45 is turned to form a leg 46 which overlies the run 29 and the section 25 and then is turned to form a bight 47 from one end of which extends a section 48 that underlies the section 25 and all of the runs. From the section 48 the working end 45 is turned to form a bight 49 from which the working end extends as a leg 50 that overlies all of the runs and the section 25 and then is reeved downwardly through the bight 47 to parallel the section 25, as is shown in FIG. 14.

The bights 28 and 43 simultaneously are moved in the direction of the arrow H and reeved downwardly through the bights 26 and 41, and the bights 26 and 41 thereafter are moved in the direction of the arrow J, producing two pairs of entwined overhand and crossing knots from which extend two loops 51 and 52. Except for the fact that the knot 40 has two loops 51 and 52 and two crossings formed by the turns 26 and 43, it corresponds to the knot 1*a*.

FIGS. 16 and 17 illustrate another method of tying the knot 1*a* wherein a rope length has a section 53 that is turned to form a bight 54 from which extends a run 55 that underlies and crosses the section 53. The working end 56 then is turned to form a loop 57 encircling the section 53 and from which extends a straight section 58. That portion of the section 53 between the bight 54 and the loop 57 then is moved in the direction of the arrow K to underlie the run 55 and overlie the section 58 and the adjacent portion of the section 53, thereby forming a crossing knot 59 as is shown in FIG. 17. The bight 54 then is drawn through the loop 57 in the direction indicated by the arrow L to form an overhand knot that is entwined with the crossing knot 59, thus producing a knot like the knot 1*a*.

The knot 1*a* also may be formed by the procedure illustrated in FIGS. 18 and 19 wherein a rope length 60 is turned to form a crossing knot 61 having a bight 62. From the bight 62 extends a section 63 that forms a bight 64 from which extends a run 65 that substantially parallels the section 63. The working end 66 of the rope is reeved downwardly through the bight 62, and then is turned and again reeved downwardly through the bight 62, as is indicated by the arrow M, to form a bight 67. The bight 64 then is reeved upwardly through the bight 67, as indicated by the arrow N, to form an overhand knot entwined with the crossing knot, thereby producing the finished knot.

FIGS. 20 and 21 illustrate another manner of tying the knot. This method is one that conveniently may be used in tying the knot completely in hand. The knot is tied in a rope 70 by forming a crossing knot 71 and then forming a loop 72 having generally parallel legs 73 and 74. The leg 74 is turned to form a section 75 that passes downwardly through the bight 76 of the crossing knot and then crosses over the upper part of the leg 73. The rope then is turned to form a section 77 that crosses under a section 78 of the rope, following which the working end 79 of the rope passes over the leg 74 and is reeved downwardly through the bight 76, passing under the leg section 75 and over the section 77, as is shown by the arrow in FIG. 20. The parts then may be tightened to produce a knot having the configuration of the knot 1a.

FIGS. 22–24 illustrate a knot having many of the characteristics referred to hereinbefore, but in this case the knot forms a running noose. The knot is formed in a rope 80 having an overhand knot 81 from the bight 82 of which extend two sections 83 and 84. The section 83 is extended and reversely turned to form a loop 85 having generally parallel legs 86 and 87. The leg 87 is reeved downwardly through the bight 82. The other section 84 is turned to form a segment 88 which overlies the leg 87. The working end 89 then is turned and reeved upwardly through the bight 82, underlying the leg 87, to form a crossing knot 90 having a bight 91. The working end 89 is turned to parallel the leg 87 and underlie the segment 88, as is shown by the arrow P in FIG. 23, to produce a knot having an appearance corresponding to that of the knot 1. However, as is best shown in FIG. 24, the leg 87 is free to move in opposite directions, as is indicated by the two-headed arrow Q, enabling the size of the loop 85 to be varied at will.

FIGS. 25–27 illustrate a knot 93 that is similar, but specifically different from than shown in FIG. 1. The knot is tied from a length of rope in which an overhand knot 94 is tied to form a bight 95 having two rope sections 96 and 97 at its opposite ends. The section 97 is turned to form a loop 98 having a pair of substantially parallel legs 99 and 100. The free end 101 of the leg 100 is reeved downwardly through the bight 95 to form a crossing knot 102. The free end 101 then is turned and moved in the direction of the arrow R to cross and overlie both of the loop legs 99 and 100 and thence is reeved upwardly through the bight 95 of the overhand knot to entwine the latter and the crossing knot and also to form a section 103 that parallels the section 96. The overhand knot 94 then may be tightened, following which the free end 101 is drawn downwardly to finish and tighten the knot 93.

The loop 98 and the standing and free ends of the knot 93 are reversed relative to the positions of the corresponding parts of the knot 1 shown in FIG. 1. Thus, there are differences in appearance between the knots 1 and 93. However, the knot 93 has all the attributes of the knot 1.

The principles of the invention are not limited to those instances in which a knot is to be tied in a single length of rope. They are applicable as well to those instances in which two ropes are to be joined or bent together. Several examples of bending are illustrated in FIGS. 28–34.

As is well known, Boy Scout organizations throughout the world are involved in the teaching of knot tying, and each Boy Scout organization has the identical Scout Law composed of twelve points. The embodiments of FIGS. 28–34 are described using these twelve points as the names of selected parts of the two ropes.

Figure 28:
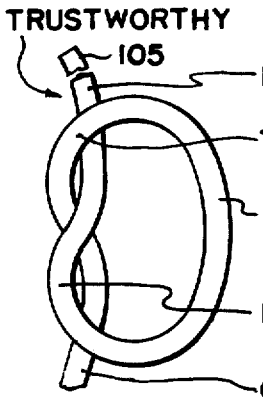
Figure 29:
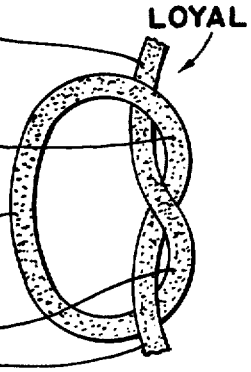

FIG. 28 illustrates one rope having a crossing knot designated generally by the term Trustworthy and FIG. 29 shows a second rope having an overhand knot designated generally by the term Loyal. The rope in which the knot Loyal is tied is stippled, whereas the rope in which Trustworthy is tied is unstippled to aid in distinguishing the two ropes from one another when they are bent together as explained below. In FIGS. 28–31 the free or working end of the rope being bent to the other is represented by the reference character 105.

As shown in FIG. 28, from opposite ends of the crossing knot Trustworthy rope sections Brave and Obedient extend in opposite directions. The section Brave terminates in the working end 105. As shown in FIG. 29, from opposite ends of the overhand knot Loyal rope sections Clean and Kind extend in opposite directions.

FIG. 30 illustrates in loose form the bend resulting from the entwining of the crossing knot Trustworthy and the overhand knot Loyal. Trustworthy has a bight Helpful including two adjacent segments Thrifty and Reverent from which extend the two strands Brave and Obedient. Loyal has a bight Cheerful including two adjacent segments Friendly and Courteous from which extend the two sections Kind and Clean, respectively.

The bend shown in FIG. 30 may be tied in a number of ways. For example, the overhand knot Loyal may be tied in one rope, following which the working end 105 of the other rope (which eventually will have the crossing knot Trustworthy formed therein) is manipulated to complete the bend. Starting at the lower end of FIG. 30 the working end 105 is reeved downwardly through the bight Cheerful and then is turned to the right to cross and overlie the section Clean. The working end 105 is passed under the segment Friendly and reeved upwardly through the bight Cheerful, and then is turned to parallel the section Clean and pass under the segment Thrifty to form the crossing knot Trustworthy. The sections Brave and Clean and the sections Obedient and Kind then may be pulled in opposite directions to tighten the bend, thereby producing a bend that conforms in appearance to the knot 1a except for the absence of the loop 10a.

FIG. 32 illustrates another method of bending two separate ropes to one another. Again, the unstippled rope has the crossing knot Trustworthy formed therein and the stippled rope has the overhand knot Loyal formed in it. Either knot may be tied first, but for ease of description it will be assumed that Loyal is tied first. Starting at the lower end of FIG. 32, the working end 106 (shown at the upper end of FIG. 32) of the unstippled rope is reeved upwardly through the bight Cheerful, turned to the left to cross and underlie the section Clean and then is extended downwardly to overlie the section Clean and pass downwardly through the bight Cheerful. The free end 106 then is turned upwardly to parallel the section Clean to form the bight Helpful and the segment Thrifty of the crossing knot Trustworthy. The free end 106 is moved upwardly to form the section Brave. Pulling the sections Brave, Clean and Kind, Obedient in opposite directions will produce a bend having the configuration of the knot 1a shown in FIGS. 3 and 4, except that no loop like the loop 10a is present.

FIG. 33 illustrates the method of bending a pair of separate ropes to one another to produce a bend which is a mirror image of that produced by the method of FIG. 32. Except for this difference the procedural steps are identical to those described with reference to FIG. 32.

FIG. 34 is illustrative of a method of bending one end of a first stippled rope to an intermediate portion of a second, unstippled rope whose terminal ends 107 and 108 are secured to fixed members 109 and 110, respectively. The procedure to be followed may correspond to that described in connection with FIGS. 28–31, but it is preferred first to form the crossing knot Trustworthy in the unstippled rope whose opposite ends are fixed. Thereafter, and starting from the lower end of FIG. 34, the working end 111 (shown at the upper end of FIG.

34) of the stippled rope may be reeved downwardly through the bight Helpful of the crossing knot Trustworthy, turned to the left and extended downwardly and thence to the right to form the bight Cheerful and the overhand knot Loyal. The working end 111 then again is reeved downwardly through the bight Helpful of Trustworthy and extended upwardly to form the section Clean. The sections Clean and Kind at opposite ends of Loyal then may be pulled in opposite directions to tighten the bend and produce a nonslipping connection of one end of the stippled rope to an intermediate part of the unstippled rope. The bend produced in accordance with FIG. 34 will have the appearance of the knot 1*a* except for the absence of the loop 10*a*.

All of the disclosed knots and bends have the common characteristics of high security, similarity of appearance, and ease of loosening and untying when desired.

The manner of loosening the knot for ease of untying can best be described by reference to FIG. 31. Assuming that the knot is tight, the initial loosening step involves pushing the section between Thrifty and Helpful (at the upper end of FIG. 31) into the plane of the paper, and then more or less simultaneously pushing the sections Brave and Clean into the plane of the paper. These manipulations should provide some slack enabling the section Reverent to be freed, following which the knot easily may be untied.

If the knot is especially tightly tied, the untying steps described above may be performed, following which the sections Obedient and Kind may be pulled upwardly out of the plane of the paper. The section between Cheerful and Courteous (at the lower end of FIG. 31) then may be pushed downwardly (as viewed in the figure), thereby freeing the sections Obdient and Kind for subsequent untying.

The foregoing description of multiple methods of producing corresponding knots and bends is not intended to be exhaustive. Other methods may be utilized without resulting in any change in the appearance or reliability of the knot.

One procedure which may be followed to devise other methods of tying the knot disclosed herein, as well as any other knot, is to start with a tied knot and untie it in as many ways as possible, carefully watching the several stages occurring during the untying operation. It then may be possible to restore one or more of such stages by manipulations that are not merely the reverse of those involved in the untying operation.

If the knot is to be used for utilitarian purposes the rope or ropes from which it is formed should be natural or synthetic fibrous materials that will withstand the intended usage and the environment of use. If the knot is to be used as an article of jewelry, or as an adornment for garments, for example, the material may be one or more filaments of precious or semi-precious metal or a combination of metallic and textile filaments braided together.

The disclosed embodiments are representative of presently preferred forms of the invention, but are intended to be illustrative rather than definitive thereof. The invention is defined in the claims.

I claim:

1. A knot or bend having front and rear sides and comprising an overhand knot (Loyal) forming a first bight (Cheerful) from opposite ends of which first (Clean) and second (Kind) sections extend in different directions, a crossing knot (Trustworthy) forming a second bight (Helpful) from which third (Brave) and fourth (Obedient) sections extend in different directions, said first and second bights being entwined, said first (Clean) and third (Brave) sections extending alongside one another and passing through said second bight (Helpful) in a direction from one side of said knot or bend to its other side, and said second (Kind) and fourth (Obedient) sections extending alongside one another and passing through said first bight (Cheerful) in a direction from said other side of said knot or bend to said one side thereof.

2. A knot according to claim 1 wherein said overhand knot and said crossing knot are formed in a single length of material.

3. A bend according to claim 1 wherein said overhand knot is formed in one length of material and said crossing knot is formed in a secpond, separate length of material.

4. A knot according to claim 1 wherein said second and fourth sections are common and together form a loop.

5. A knot according to claim 4 wherein said loop comprises a running noose.

6. A knot or bend according to claim 1 wherein said first and third sections underlie a segment of said second bight at one end of said overhand knot.

7. A knot or bend according to claim 1 wherein said first and thirs sections overlie a segment of said second bight at one end of said overhand knot.

8. A knot having front and rear sides and comprising an overhand knot and a crossing knot formed in a single length of material, said overhand knot forming a first bight from which first and second sections extend in opposite directions, said crossing knot forming a second bight from which third and fourth sections extend in different directions, said second bight having a segment thereof passing through said first bight in a direction from one side of said knot to the other to entwine said bights, said first and third sections extending alongside one another and passing through said second bight in a direction from one side of said knot to its other side, and said second and fourth sections extending alongside one another and passing through said first bight in a direction from said other side of said knot to said one side thereof.

9. A knot according to claim 8 wherein two of said sections extending alongside one another are common and together form a loop extending from one end of said knot.

10. A knot according to claim 9 wherein said two of said sections are said second and fourth sections.

11. A knot according to claim 8 wherein said first and third sections and said segment of said second bight pass through said first bight in the same direction.

12. A knot according to claim 8 wherein said first and third sections and said segment of said second bight pass through said first bight in the opposite direction.

13. A knot according to claim 8 wherein said first and third sections cross said first bight on the front side of said knot.

14. A knot according to claim 8 wherein said first and third sections cross said first bight on the rear side of said knot.

15. A bend having front and rear sides and comprising an overhand knot (Loyal) formed in one length of material and a crossing knot (Trustworthy) formed in a second length of material, said overhand knot forming a first bight (Cheerful) from which first (Clean) and second (Kind) sections extend in opposite directions, said crossing knot forming a second bight (Helpful) from which third (Brave) and fourth (Obedient) sections extend in different directions, said second bight having a segment (Reverent) thereof passing through said first bight in a direction from one side of said bend to the other to entwine said bights, said first (Clean) and third (Brave) sections extending alongside one another and passing through said second bight (Helpful) in a direction from one side of said bend to its other side, and said second (Kind) and fourth (Obedient) sections extending alongside one another and passing through said first bight (Cheerful) in a direction from said other side of said bend to said one side thereof.

16. A bend according to claim 15 wherein said first and third sections and said segment of said second bight pass through said first bight in the same direction.

17. A bend according to claim 15 wherein said first and third sections and said segment of said second bight pass through said first bight in the opposite direction.

18. A bend according to claim 14 wherein said first and third sections cross said first bight on the front side of said bend.

19. A bend according to claim 15 wherein said first and third sections cross said first bight on the rear side of said bend.

* * * * *

UNITED STATES PATENT AND TRADEMARK OFFICE

CERTIFICATE OF CORRECTION

PATENT NO. : 4,711,476

DATED : December 8, 1987

INVENTOR(S) : Alden W. Hanson

It is certified that error appears in the above-identified patent and that said Letters Patent is hereby corrected as shown below:

Column 8, line 17, "secpond" should read -- second --

Column 8, line 28, "thirs" should read -- third --.

Signed and Sealed this

Seventh Day of June, 1988

*Attest:*

DONALD J. QUIGG

*Attesting Officer*

*Commissioner of Patents and Trademarks*